United States Patent [19]

Miller

[11] Patent Number: 4,747,932

[45] Date of Patent: May 31, 1988

[54] THREE-STEP CATALYTIC DEWAXING AND HYDROFINISHING

[75] Inventor: Stephen J. Miller, San Francisco, Calif.

[73] Assignee: Chevron Research Company, San Francisco, Calif.

[21] Appl. No.: 850,316

[22] Filed: Apr. 10, 1986

[51] Int. Cl.[4] ..... C10G 65/12

[52] U.S. Cl. ..... 208/61; 208/18; 208/58; 208/97; 208/254 H; 208/111

[58] Field of Search ..... 208/18, 59, 58, 61, 208/97, 254 H, 89, 111

[56] References Cited

U.S. PATENT DOCUMENTS

| | | | |
|---|---|---|---|
| 2,967,147 | 1/1961 | Cole | 208/144 |
| 3,227,661 | 1/1966 | Jacobson et al. | 502/314 |
| 3,317,419 | 5/1967 | Fortman | 208/97 |
| 3,666,657 | 5/1972 | Thompson et al. | 208/18 |
| 3,684,684 | 8/1972 | Coleman et al. | 208/18 |
| 3,730,876 | 5/1973 | Sequeira, Jr. | 208/58 |
| 3,852,207 | 12/1974 | Stangeland et al. | 208/58 |
| 3,941,680 | 3/1976 | Bryson et al. | 208/18 |
| 4,162,962 | 7/1979 | Stangeland | 208/18 |
| 4,183,801 | 1/1980 | Breuker et al. | 208/18 |
| 4,325,804 | 4/1982 | Everett et al. | 208/58 |
| 4,325,805 | 4/1982 | Miller | 208/61 |
| 4,347,121 | 8/1982 | Mayer et al. | 208/58 |
| 4,414,097 | 11/1983 | Chester et al. | 208/61 |
| 4,419,220 | 12/1983 | LaPierre et al. | 585/739 |
| 4,518,485 | 5/1985 | LaPierre et al. | 208/111 |
| 4,561,967 | 12/1985 | Miller | 208/61 |
| 4,608,151 | 8/1986 | Miller | 208/97 |
| 4,610,778 | 9/1986 | Graven | 208/89 |
| 4,627,908 | 12/1986 | Miller | 208/58 |

*Primary Examiner*—Helen M. S. Sneed
*Assistant Examiner*—Anthony McFarlane
*Attorney, Agent, or Firm*—S. R. LaPaglia; G. D. Haynes; V. J. Cavalieri

[57] ABSTRACT

A process for dewaxing and stabilizing a hydrocracked bright stock, comprising hydrodenitrification, catalytic dewaxing, and mild hydrofinishing.

16 Claims, No Drawings

THREE-STEP CATALYTIC DEWAXING AND HYDROFINISHING

BACKGROUND OF THE INVENTION

This invention relates to a process for the catalytic dewaxing of hydrocracked bright stock which improves bulk oxidation stability and storage stability. The term "oxidation stability" refers to the resistance of the oil to oxygen addition, in other words, how rapidly is oxygen picked up by and added to molecular species within the oil. Oxidation stability is indicated by the oxidator BN measured in hours. Oxidator BN is thoroughly described in U.S. Pat. No. 3,852,207 granted Dec. 3, 1974 to B. E. Stangeland et al at column 6, lines 15–30. Basically, the test measures the time required for 100 grams of oil to absorb one liter of oxygen. The term "storage stability" refers to the resistance of the oil to floc formation in the presence of oxygen.

In general, refineries do not manufacture a single lube base stock but rather process at least one distillate fraction and the vacuum residuum. For example, three distillate fractions differing in boiling range and the residuum may be refined. These four fractions have acquired various names in the refining art, the most volatile distillate fraction often being referred to as the "light neutral" fraction or oil. The other distillates are called "medium neutral" and "heavy neutral" oils. The residuum fraction is commonly referred to as "bright stock". Thus, the manufacture of lubricant base stocks involves a process for producing a slate of base stocks, which slate may include a bright stock.

Processes have been proposed to produce lubricating oil base stocks by refining bright stocks. Many of these processes use a hydrocracking step to produce a bright stock hydrocrackate which is in turn dewaxed to provide a dewaxed bright stock. The problem is that such hydrocracked stocks tend to have poor storage stability.

Moreover, since many process schemes proposed for hydrocracked stocks also involve the use of catalytic dewaxing to lower the pour point followed by solvent dewaxing to produce a dewaxed bright stock efforts have been made to develop improved dewaxing catalysts. Recently, it has been proposed to use shape-selective zeolitic dewaxing catalysts to crack, preferably hydrocrack, the paraffinic components contained in the bright stock.

Various zeolitic catalytic dewaxing processes have been proposed. For example: U.S. Pat. No. 4,472,266 (hydrodewaxing of lube oils with Mo, Ni-Mo or Co-Mo on ZSM-5 type catalysts); U.S. Pat. No. 4,437,976 (two-stage hydrocarbon dewaxing hydrotreating process using a hydrotreating catalyst from the class of ZSM-5, ZSM-11, ZSM-23, and ZSM-35 zeolites); and U.S. Pat. No. 4,222,855 (catalytic dewaxing of hydrocarbon oils using ZSM-23 or ZSM-35 zeolite catalysts).

A major problem is, however, that these catalytic dewaxing processes are adversely affected by catalyst poisons present in hydrocarbonaceous feedstocks. In particular, feedstocks often contain organic nitrogen that has detrimental effects upon zeolite catalytic activity. The narrow pore openings of the zeolites are quickly fouled and rendered ineffective by such catalyst poisons. In addition, the lubricating oil base stock derived from catalytic dewaxing of hydrocracked stocks is unstable in the presence of oxygen and light; further processing is required to make a stable oil.

In order to overcome the instability problems of hydrocracking stocks, the typical dewaxed hydrocrackate stock is hydrofinished by a mild hydrogenation process to increase the resistance of the bulk oil toward oxidation. The goal of this process is to hydrogenate those species which readily react with oxygen, while minimizing further cracking and loss of the lubricant base stock. Even though the hydrofinished product has high resistance toward bulk oxidation, its storage stability is often low. It is believed that this is due to the difficulty of totally saturating the floc-forming agents, thought to be partially hydrogenated polycyclic aromatics. These agents, upon reaction with oxygen, can lead to floc formation during storage of the oil.

There are several nonhydrogenation processing techniques recommended in the patent literature as methods to achieve improved lubricant storage stability. Some of the earlier efforts concentrated on the addition of stabilizing agents to a dewaxed hydrocrackate while in the presence of a heterogeneous acidic catalyst. Several issued patents relate to stabilizing hydrocracked lubricant base stocks by adding stabilizing agents such as olefins, alcohols, esters or alkylhalides to the lube stock while in the presence of a heterogenous acidic catalyst such as acid resins, clays, and alumino silicates having controlled alkylation activity. For instance, U.S. Pat. Nos. 3,928,171 and 4,181,597 disclose processes for stabilizing hydrocracked lube oils which have been dewaxed, preferably solvent dewaxed, by contacting them with stabilizing agents such as $C_6$ to $C_{10}$ olefins.

In spite of the large amount of research into developing lubricant base stocks, dewaxing and stabilizing them, the mechanism responsible for the benefits obtained when using a stabilizing agent was not entirely understood. Because the stabilizing agent is consumed during the stabilization reaction, however, it is likely that a reaction occurs between one or more components of the dewaxed lube oil stock and the stabilizing agent. In particular, conditions during the stabilization process are conducive to alkylation. Nonetheless, these earlier efforts refrain from asserting that any mechanism can be identified as the stabilizing reaction.

It has now been discovered that a three-step process comprising a first step to substantially remove nitrogen and sulfur contaminants, a second step to catalytically dewax, and a third step to thoroughly hydrogenate unstable polycyclics will produce a more stable dewaxed lubricating oil base stock from hydrocracked bright stock.

SUMMARY OF THE INVENTION

The discovery of the present invention is embodied in a process for preparing a dewaxed, stabilized lubricating oil base stock from hydrocracked bright stock. The process comprises the following three steps:

(a) contacting said hydrocracked bright stock with hydrogen in the presence of a catalyst having hydrodenitrification activity under conditions effective to reduce nitrogen content of said stock to produce a substantially nitrogen-free product;

(b) contacting said substantially nitrogen-free product with a catalyst having dewaxing activity to produce a dewaxed oil; and (c) contacting said dewaxed oil with hydrogen in the presence of a catalyst having hydrogenation activity under mild conditions to produce a dewaxed and stabilized lubricating oil base stock.

DETAILED DESCRIPTION OF THE INVENTION

The process comprises three steps. In the first step, a hydrocracked bright stock is hydrodenitrified using, for example, a sulfided nickel-tin or nickel-molybdenum hydrotreating catalyst having a siliceous or alumina matrix. In the second step, the substantially nitrogen-free product is catalytically dewaxed, using, for example, a zeolite catalyst. In the third step, the dewaxed stock is hydrofinished using, for example, an unsulfided nickel-tin or palladium hydrotreating catalyst having a siliceous or alumina matrix.

The first and third steps are carried out at an unusually low liquid hourly space velocity (LHSV), about 0.25 hr.$^{-1}$. In the first step, a low LHSV permits the desired hydrodenitrification reaction to proceed at relatively low temperatures, about 700° F. Under these conditions, hydrocracking is minimized. In the third step, a low LHSV permits thorough saturation of aromatics which are floc-forming species. Thus, in general, the first step removes nitrogen and sulfur, known catalyst poisons, and improves oxidation stability; the second step, dewaxes the stock; and the third step saturates aromatic floc precursors and improves storage stability. Accordingly, it has been found that this process produces a dewaxed lube oil base stock of significantly improved stability.

The hydrocarbonaceous feeds from which the bright stock is used in the process of this invention usually contain aromatic compounds as well as normal and branched paraffins of very long chain lengths. These feeds usually boil in a gas oil range. Preferred feedstocks are vacuum gas oils with normal boiling ranges above about 350° C. and below about 600° C., and deasphalted residual oils having normal boiling ranges above about 480° C. and below about 650° C. Reduced top crude oils, shale oils, liquefied coal, coke distillate, flask or thermally cracked oils, atmospheric residua, and other heavy oils, can also be used as the feed source.

Typically, the hydrocarbonaceous feed is distilled at atmospheric pressure to a reduced crude (residuum) which is then vacuum distilled to produce a distillate fraction and a vacuum residuum fraction. According to the present process, the vacuum residuum fraction is then hydrocracked using standard reaction conditions and catalysts in one or more reaction zones.

In the first step of the present process, the bright stock is hydrodenitrified to reduce its nitrogen level. Conventional hydrodenitrification catalysts and conditions can be used when carrying out this step. For the third step, to achieve aromatic saturation of the hydrocracked bright stock, however, the first step must employ a combination of catalysts and hydrogenation conditions which will reduce the nitrogen level of the stock to below about 50 ppm by weight. In addition to the desired hydrodenitrification, such catalysts and conditions will inherently result in cleavage of carbon sulfur bonds to form hydrogen sulfide. This results in some level of hydrodesulfurization. Organic sulfur is deleterious to the activity of the final hydrofinishing step. It is desirable to reduce the sulfur level to less than about 50 ppm, preferably less than about 10 ppm, and most preferably less than about 3 ppm.

Typical hydrodenitrification catalysts suitable for use in the first step comprise a Group VIIIA metal, such as nickel or cobalt, and a Group VIA metal, such as molybdenum or tungsten (unless otherwise noted, references to the Periodic Table of Elements are based upon the IUPAC notation) with a siliceous or alumina matrix. Such catalysts are well known in the art. U.S. Pat. No. 3,227,661 describes a method which may be used to prepare a suitable hydrodenitrification catalyst.

Typical hydrodenitrification conditions which are useful in the first step of the present process vary over a fairly wide range. In general, temperatures range from about 600° F. to about 850° F., preferably about 650° F. to about 800° F.; pressures range from about 500 psig to about 4000 psig, preferably from about 1500 psig to about 3000 psig; contact times expressed as LHSV range from about 0.1 hr.$^{-1}$ to about 3.0 hr.$^{-1}$, preferably from about 0.1 hr.$^{-1}$ to about 0.8 hr.$^{-1}$; hydrogen rates range from about 5000 cu/ft. per barrel to about 15000 cu/ft. per barrel; and a substantial hydrogen partial pressure. U.S. Pat. No. 3,227, 661 describes those conditions required for various processing schemes using the denitrification catalysts taught in that patent. A general discussion of hydrodenitrification is available in U.S. Pat. No.3,073,221. As discussed, when selecting denitrification conditions from the general teachings of the art, the main concern is the use of relatively low LHSV and temperature to achieve nearly complete denitrification with minimal hydrocracking.

In the second step of the present process, the denitrified stock is dewaxed using conventional catalytic dewaxing processes. Because the nitrogen content of the stock is low, the run length of this step can be relatively long. Examples of suitable zeolites for use in catalytic dewaxing are the group consisting of ZSM-5, ZSM-8, ZSM-11, ZSM-23, and ZSM-35. Such catalysts are detailed, for example, in U.S. Pat. No. 4,472,266 to Oleck et al; U.S. Pat. No. 4,437,976 to Oleck et al; U.S. Pat. No. 4,259,174 to Chen et al; U.S. Pat. No. 4,222,855 to Pelrine et al; and U.S. Pat. No. 4,176,050 to Chen et al. These patents are herein incorporated by reference.

The dewaxing step of the invention may be conducted by contacting the feed to be dewaxed with a fixed stationary bed of catalyst, or with a transport bed, as desired. A simple and therefore preferred configuration is a trickle-bed operation in which the feed is allowed to trickle through a stationary fixed bed.

Suitable dewaxing conditions include temperature ranging from about 400° F. to about 800° F., preferably about 500° F. to about 700° F.; a pressure ranging from about 500 psig to about 4000 psig, preferably about 1500 psig to about 3000 psig; and an LHSV ranging from about 3.2 hr.$^{-1}$ to about 10 hr.$^{-1}$, preferably about 0.5 hr.$^{-1}$ to about 5.0 hr.$^{-1}$.

In the third step of the present process, the dewaxed stock is hydrofinished using mild hydrogenation catalysts and conditions. Suitable catalysts can be selected from conventional hydrofinishing catalysts having hydrogenation activity. Because this step can proceed under mild conditions when a low LHSV is employed, it is preferable to use a hydrogenation catalyst, such as, for example, a noble metal from Group VIIIA, such as palladium, on a refractory oxide support or unsulfided Group VIIIA and Group VI, such as nickel-molybdenum or nickel-tin catalysts. U.S. Pat. No. 3,852,207, granted on Dec. 3, 1974 to Stangeland et al, describes a suitable noble metal catalyst and mild conditions and is herein incorporated by reference.

As noted, suitable hydrofinishing conditions should be selected to achieve as complete hydrogenation of unsaturated aromatics as possible. Because the first step has removed the common hydrogenation catalyst poisons, the third step run length can be relatively long affording the opportunity to use a relatively low LHSV and mild conditions. Suitable conditions include a temperature ranging from about 300° F. to about 600° F., preferably about 350° F. to about 550° F., and is below the temperature at which the hydrodenitrification is carried out; a pressure ranging from about 500 psig to about 4000 psig, preferably about 1500 psig to about 3000 psig; an LHSV ranging from about 0.1 $hr.^{-1}$ to about 2.0 $hr.^{-1}$, preferably, about 0.1 $hr.^{-1}$ to about 0.5 $hr.^{-1}$; and a substantial hydrogen partial pressure. Thus, in general terms, the hydrodenitrified, dewaxed effluent of the first two steps is contacted with hydrogen in the presence of a hydrogenation catalyst under mild hydrogenation conditions. Other suitable catalysts are detailed, for example, in U.S. Pat. No. 4,157,294 granted June 5, 1979 to Iwao et al and U.S. Pat. No. 3,904,513 granted Sept. 9, 1975 to Fischer et al, both incorporated herein by reference.

The present invention is exemplified below. The example is intended to illustrate a representative embodiment of the invention. Those familiar with the art will appreciate that other embodiments of the invention will provide equivalent results without departing from the essential features of the invention.

EXAMPLES

A waxy hydrocracked bright stock (see Table I) is hydrofinished in the first stage of the present process over a presulfided proprietary cogelled Ni-Sn-$SiO_2$-$Al_2O_3$ catalyst comprising 9.6 wt.% Ni and 3.4 wt.% Sn at 0.25 LHSV, 2000 psig, 8 M SCF/bbl $H_2$ and 570°–620° F. to obtain a product with less than 10 ppm, nitrogen. The product is dewaxed over a 0.6% Pd on HZSM-5 catalyst bound with 35% Catapal alumina at 0.5 LHSV, 2000 psig, 8 M SCF/bbl $H_2$, and 600°–700° F. The product from this stage is subsequently hydrofinished in a third stage over a catalyst composed of 2 wt.% palladium on silica-alumina. Hydrofinishing conditions are 0.25 LHSV, 400° F., 2000 psig, and 8 M SCF/bbl $H_2$. The process yields a dewaxed bright stock of improved oxidation and storage stability.

TABLE I

| Hydrocracked Bright Stock Inspections | |
|---|---|
| Gravity, °API | 26.1 |
| Sulfur, ppm | 84 |
| Nitrogen, ppm | 112 |
| Pour Point, °F. | >80 |
| Viscosity, cSt, 100° C. | 26.49 |
| Distillation, LV %, °F. | |
| ST/5 | 970/992 |
| 10 | 1009 |

What is claimed is:

1. A process for preparing a dewaxed, stabilized lubricating oil base stock from a hydrocracked bright stock, comprising:

(a) contacting said hydrocracked bright stock with hydrogen in the presence of a catalyst having hydrodenitrification activity under conditions effective to reduce nitrogen content of said stock to below about 50 ppm by weight and to minimize hydrocracking to produce a substantially nitrogen-free product;

(b) contacting said substantially nitrogen-free product with a catalyst having a dewaxing activity to produce a dewaxed oil; and (c) contacting said substantially nitrogen-free, dewaxed product with hydrogen in the presence of a catalyst having hydrogenation activity under mild conditions to produce a dewaxed and stabilized lubricating oil base stock having improved oxidation stability.

2. A process according to claim 1 wherein the catalyst having hydrodenitrification activity comprises at least one metal from Group VIIIA and at least one metal from Group VIA or tin supported on an alumina or siliceous matrix.

3. A process according to claim 2 wherein said Group VIIIA metal is nickel or cobalt and said Group VIA metal is molybdenum or tungsten.

4. A process according to claim 2 or 3 wherein said catalyst is sulfided.

5. A process according to claim 1 wherein said hydrodenitrification is carried out at a temperature ranging from about 600° F. to about 850° F., a pressure ranging from about 500 psig to about 4000 psig, and a space velocity LHSV ranging from about 0.1 $hr.^{-1}$ to about 3 $hr.^{-1}$.

6. A process according to claim 5 wherein said LHSV is from about 0.1 $hr.^{-1}$ to about 0.8 $hr.^{-1}$.

7. A process according to claim 6 wherein said LHSV is about 0.25 $hr.^{-1}$.

8. A process according to claim 1 wherein said catalyst having dewaxing activity is a zeolite catalyst.

9. A process according to claim 8 wherein said catalyst having dewaxing activity is selected from the group consisting of ZSM-5, ZSM-8, ZSM-11, ZSM-23, and ZSM-35.

10. A process according to claim 1 wherein said catalytic dewaxing of the substantially nitrogen-free product is carried out at a temperature ranging from about 400° F. to about 800° F., a pressure ranging from about 500 psig to about 4000 psig, and a space velocity LHSV ranging from about 0.2 $hr.^{-1}$ to about 10 $hr.^{-1}$.

11. A process according to claim 1 wherein said catalytic dewaxing is carried out at a temperature ranging from about 500° F. to about 700° F., a pressure ranging from about 1500 psig to about 3000 psig, and a space velocity LHSV ranging from about 0.5 $hr.^{-1}$ to about 5 $hr.^{-1}$.

12. A process according to claim 1 wherein said catalyst having hydrogenation activity comprises at least one Group VIIIA noble metal supported on a refractory oxide.

13. A process according to claim 12 wherein said noble metal is palladium.

14. A process according to claim 1 wherein said hydrogenation of the substantially nitrogen-free, dewaxed product is carried out at a temperature ranging from about 300° F. to about 600° F. and is below the temperature at which the hydrodenitrification is carried out, a pressure ranging from about 500 psig to about 4000 psig, and a space velocity LHSV ranging from about 0.1 $hr.^{-1}$ to about 2.0 $hr.^{-1}$.

15. A process according to claim 14 wherein said LHSV ranges from about 0.1 $hr.^{-1}$ to about 0.5 $hr.^{-1}$.

16. A process according to claim 15 wherein said LHSV is about 0.25 $hr.^{-1}$.

* * * * *